United States Patent [19]

McCord, Jr.

[11] Patent Number: 4,607,673

[45] Date of Patent: Aug. 26, 1986

[54] DOVETAIL FIXTURE

[75] Inventor: Wilfred M. McCord, Jr., Louisville, Ky.

[73] Assignee: Vermont American Corporation, Louisville, Ky.

[21] Appl. No.: 697,254

[22] Filed: Feb. 1, 1985

[51] Int. Cl.[4] ..... B27F 1/08

[52] U.S. Cl. ..... 144/144.5 R; 144/85; 269/41

[58] Field of Search ..... 144/85, 87, 144.5; 269/41, 87.1; 83/821

[56] References Cited

U.S. PATENT DOCUMENTS

| | | | |
|---|---|---|---|
| 3,057,383 | 10/1962 | Waite | 144/85 |
| 3,109,466 | 11/1963 | Jones | 144/144.5 |
| 3,834,435 | 9/1974 | McCord, Jr. | 144/87 |
| 4,074,736 | 2/1978 | Wolff | 144/144.5 |
| 4,168,730 | 9/1979 | Keller | 144/87 |
| 4,428,408 | 1/1984 | Grisley | 144/87 |

*Primary Examiner*—Francis S. Husar
*Assistant Examiner*—Jorji M. Griffin
*Attorney, Agent, or Firm*—Harry B. O'Donnell, III

[57] ABSTRACT

A dovetail fixture for clamping and holding two workpieces and for guiding a cutting tool whereby mortises are cut in one workpiece and tenons are concurrently cut in the other workpiece. The fixture includes a guide template having a plurality of spaced apart fingers formed along at least one edge of the template and defining blind-ended spaces between its adjacent fingers. As the cutting tool is moved along the edge of the template having the fingers, mortises are cut in one workpiece and tenons are cut in the other workpiece.

19 Claims, 6 Drawing Figures

DOVETAIL FIXTURE

BACKGROUND OF THE INVENTION

1. Field of the Invention

The present ivention relates to cutting jigs and fixtures, and more particularly to fixtures used to cut mating mortises and tenons, such as dovetail and pin formations, in workpieces.

2. Discussion of the Prior Art

Various jigs and fixtures used to cut mating mortises and tenons are known.

By way of example, different types of such jigs and fixtures are described in U.S. Pat. Nos. 3,057,383, issued on Oct. 9, 1962 to J. L. Waite; U.S. Pat. No. 3,109,466, issued on Nov. 5, 1963 to B. E. Jones; U.S. Pat. No. 3,834,435, issued on Sept. 10, 1974 to W. M. McCord, Jr.; U.S. Pat. No. 4,168,730, issued on Sept. 25, 1979; and U.S. Pat. No. 4,428,408 issued on Jan. 31, 1984 to Kenneth M. Grisley. Such old fixtures include a horizontal table and a vertical apron and independent clamps for holding two workpieces, such as drawer, box, or bookcase sides are rigidly held at a right angle to each other. A slotted guide member is held against one of the workpieces for guiding a cutting tool, such as a router, so that the cutting bit traces the pattern of the slotted guide member to form a dovetail pattern on the workpieces.

While such known fixtures vary in their capabilities, they seem to be adequate for producing a continuous type dovetail join, i.e., those dovetail joints wherein the mortises defined by the spaces between adjacent tenons are substantially the same width as the tenons. The problem is that it can occur that when using such a continuous type dovetail joint that the middle or edge of a tenon or mortise will be located at the end of a workpiece. This condition leads to an unattractive joint when the two workpieces are assembled with their respective mortises and tenons interlocking, because the first and last tenons of a row will not be equally spaced from the opposite ends of the joint, or less than a complete tenon will be located at an end of a joint.

SUMMARY OF THE INVENTION

The present invention recognizes this just-noted deficiency of the heretofore known jigs and fixtures, and provides a solution which is straightforward and easily used, even by a novice.

An object of the present invention is to provide a dovetail fixture and cutter guide member for producing a dovetail joint pattern wherein the width of the mortises defined by adjacent tenons is of a different width than the width of the tenons.

Another object of the present invention is to provide a dovetail fixture and cutter guide member providing for the easy centering of a tenon on a workpiece with either an odd number or even number, as may be dictated by the width of the workpiece, of whole tenons to each side of the center tenon.

Yet a further object of the present invention is to provide a dovetail fixture for holding two workpieces at a right angle to each other, in spaced apart mutual relationship, and in position such that interlocking tenons and mortises can be concurrently formed in both workpieces.

More particularly, the present invention provides, in one embodiment, a dovetail fixture comprising a base having a generally horizontal, planar top surface and a generally vertical, planar front surface substantially perpendicular to the top surface, means for clamping a second workpiece on the base top surface, and a generally flat template having at least one of its edges formed with a plurality of spaced apart cutting tool guide fingers, the space between adjacent fingers defining blind-ended cutting tool guide slots having a step formed at its blind end, the template being adapted to be positioned over the second workpiece on the base top surface with the distal end of the fingers located over the first workpiece clamped against the base front surface and the depest portion of the stepped guide slot disposed over the second workpiece of the base top surface.

In another embodiment, the present invention provides a cutter guide member for a dovetail fixture for guiding a cutting tool in cutting spaced apart, interlocking mortises and tenons comprising a generally flat template having at least one of its edges formed with a plurality of spaced apart cutting tool guide fingers, the space between adjacent fingers defining blind-ended cutting tool guide slots, and each of the cutting tool guide slots having a step formed at its blind end.

BRIEF DESCRIPTION OF THE DRAWINGS

The present invention wll become even more clear upon reading the following discussion in conjunction with the accompanying drawings in which like numerals refer to like parts throughout the several views and wherein.

DETAILED DESCRIPTION

Figure 1:
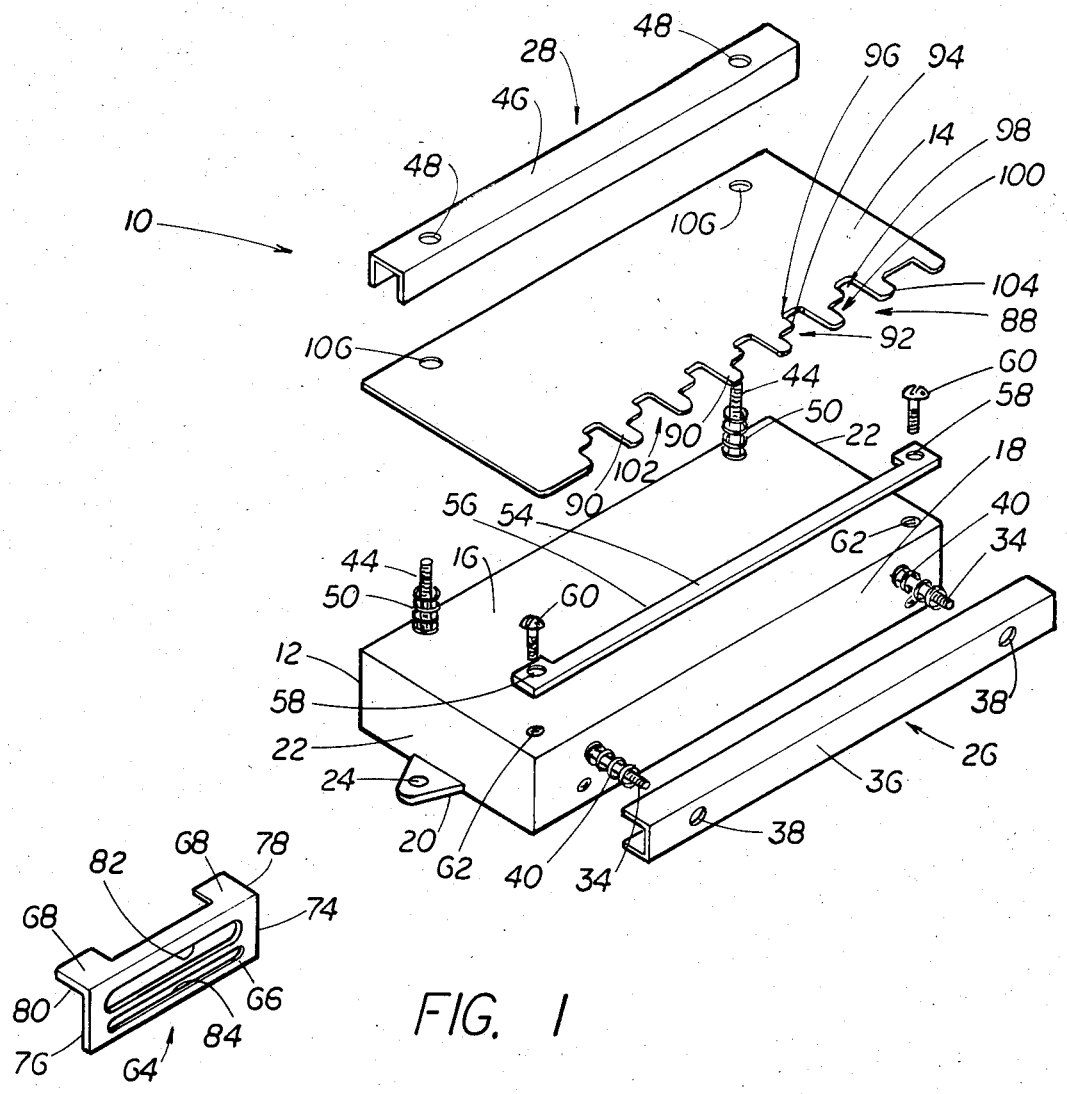
FIG. 1 is an exploded perspective view of a form of the novel dovetail fixture and cutter guide member that is provided in accordance with the present invention.
Figure 2:
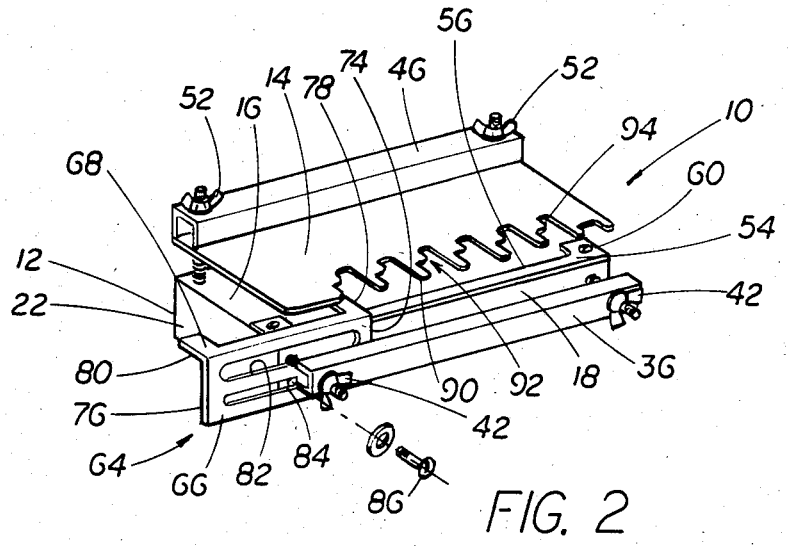
FIG. 2 is a perspective assembled view of the dovetail fixture of FIG. 1, with a locating component placed in one location.
Figure 3:
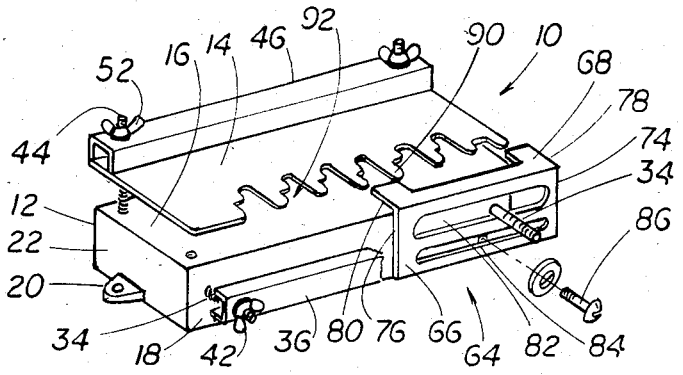
FIG. 3 is a perspective assembled view of the dovetail fixture of FIG. 1, with the locating component placed in another location.

Turning now to the drawings and, more particularly to FIGS. 1–3 thereof, there is shown a form of the dovetail fixture 10 that is provided in accordance with the present invention, including a base 12 and a cutter guide member 14.

The base 12 has a generally horizontal, planar top surface 16, and a generally vertical, planar front surface 18 substantially perpendicular to the base top surface 16. The base 12 can also have flanges 20 at its opposite ends 22 formed with bolt holes 24 so that the fixture 10 can be affixed to a workbench (not shown) by fasteners such as bolts received through the bolt holes 24. The base 12 can be fabricated of virtually any rigid material such as, for example, plastic, metal or wood.

Figure 4:
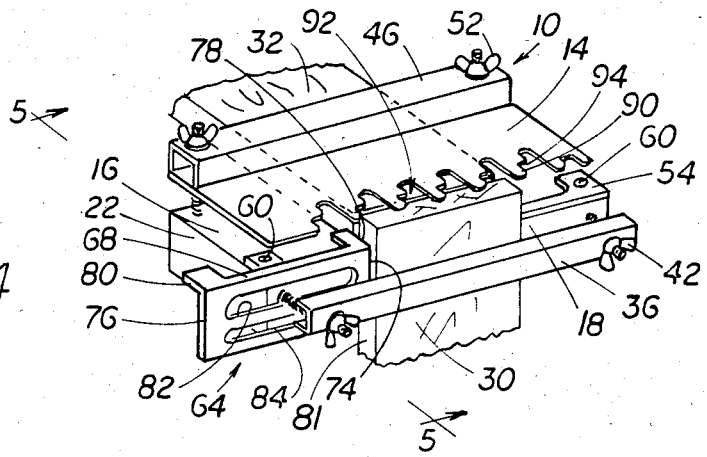
FIG. 4 is a perspective assembled view of the dovetail fixture of FIG. 1, with workpieces located thereon.
Figure 5:
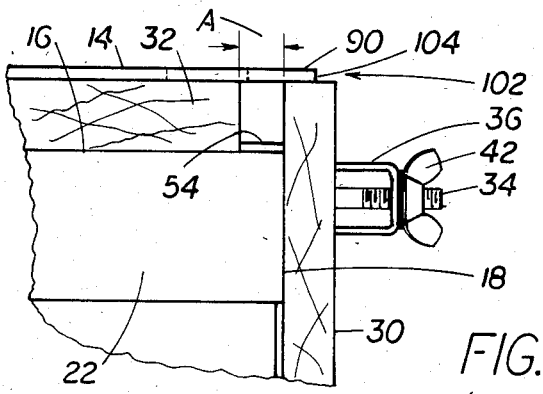
FIG. 5 is a fragmentary left side elevational view of a portion of the fixture shown in FIG. 4.

The fixture 10 further includes front surface clamping means 26 and top surface clamping means 28. As can be seen in FIGS. 4 and 5, the front surface clamping means 26 is used to clamp a first workpiece 30 against the base front surface 18 and the top surface clamping means 28 is used to clamp a second workpiece 32 against or on the base top surface 16.

The front surface clamp means 26 is shown in FIGS. 1–3 as including a pair of studs 34 extending perpendicularly outwardly from the base front surface 18 in parallel, space apart relationship, and an elongated clamping bar 36 having a pair of stud receiving apertures 38 spaced apart by a distance equal to the distance between the studs 34. The front clamping bar 36 is located along the base front surface 18 in generally parallel relationship with the base top surface 16 with a different one of the studs 34 received through a different one of the stud receving apertures 38. A compression coil spring 40 is coaxially received over each stud 34 interposed between the base front surface 18 and front clamping bar 36 to bias the clamp bar 36 away from the base front surface 18 to facilitate the insertion and removing of a first workpiece 30 therebetween. Threaded fasteners, such as wing nuts 42, are threaded on the portion of each stud 34 extending through the apertures 38 in the front clamp bar 36 so that the front clamp bar 36 can be moved toward the front clamp bar 36.

The top surface clamping means 28 is shown in FIGS. 1–3 as including a pair of studs 44 extending perpendicularly upwardly from the base top surface 16 in parallel, spaced apart relationship, and a top clamping bar 46 having a pair of stud receiving apertures 48 spaced apart by a distance equal to the distance between the studs 44. The top clamping bar 46 is located along the base top surface 16 in generally parallel relationship with the base front surface 18, with a different one of the studs 44 received through a different one of the stud receiving apertures 48. A compression coil spring 50 is coaxially received over each stud 44 interposed between the base top surface 16 and top clamping bar 46 to bias the clamp bar 46 away from the base top surface 16 to facilitate the insertion and removing of a second workpiece 32 therebetween. Threaded fasteners, such as wing nuts 52, are threaded on the portion of each stud 44 extending through the apertures 48 in the top clamp bar 46 so that the top clamp bar 48 can be moved toward the base top surface 16 by tightening the wing nuts 52 toward the top clamp bar 46.

As further illustrated in FIGS. 1, 2 and 4, the fixture 10 includes second workpiece positioning means 54 for locating the second workpiece 32 at a preselected position on the base top surface 16 relative to the base front surface 18. As shown, the positioning means 54, in the form of a positioning bar, is located on the base top surface 16, parallel to the base front surface 18 and defines an elongated second workpiece abutment edge 56 of the positioning means bar 54 that is located parallel to the base front surface 18 and is spaced rearwardly on the base top surface 16 from the base front surface 18 by the predetermined distance A by which the second workpiece 32 is to be spaced from the first workpiece 30, as can be best seen in FIG. 5. Desirably, this predetermined spacing distance A is equal to at least one-half of the diameter of the cutter tool bit. As shown, the positioning bar 54 is flat and includes bolt receiving apertures 58 at its opposite ends for receiving hold down bolts 60 which are threaded into appropriately located threaded bolt holes 62 in the base top surface 16.

With reference to FIGS. 1–4, the fixture 10 further includes first workpiece locating means 64 for locating the first workpiece 30 at a selected position on the base front surface 18 in alignment with the second workpiece 32 on the base top surface 16. The first workpiece locating means 64 is shown as a bracket having a front flange 66 adapted to overlay the base front surface 18 and a top flange 68, extending perpendicular from the top edge of the front flange 66, adapted to overlay the base top surface 16. The front flange 66 defines a left side first workpiece abutment edge 74 at one end of the front flange 66 and a right side first workpiece abutment edge 76 at the opposite end of the front flange 66. The top flange 68 defines a left side second workpiece abutment edge 78 in alignment with the abutment edge 74 of the front flange 66 at one end of the top flange 68 and a right side second workpiece abutment edge 80 at alignment with the abutment edge 76 of the front flange 66 at the other end of the top flange 66. An elongated stud clearance slot 82 is formed in the front flange 66 symetrically located to eiter side of the center of the front flange for receiving one of the studs 34 holding the clamping bar 36 to the base front surface 18. A second elongated fastening bolt receiving slot 84 is also formed in the front flange 66 in spaced apart, parallel relationship to the stud clearance slot 82. The workpiece locating bracket 64 is held in place at a selected location on the base front surface 18 by means of a bolt 86 threaded into an appropriate threaded hole in the base front surface 18. When the position of the locating bracket 64 is adjusted by loosening the bolt 86 and sliding the locating bracket along the base front surface 18, the stud 34 slides in the elongated clearance slot 82 and the bolt 86 slides in the elongated slot 86. The bolt 86 is threaded down against the front flange 66 to hold the locating bracket 64 at the selected position.

Referring now to FIGS. 1–4 and 6, the cutter guide member 14 is shown in the form of a flat template having at least one of its edges, generally denoted by the numeral 88, formed with a plurality of spaced apart cutting tool guide fingers 90. The space between adjacent fingers 90 defines blindended cutting tool guide slots 92. Each of the cutting tool guide slots 92 is wider than a finger 90 and has a step 94 formed at its blind end 96. The step 94 defines an offset area 98 that is located to one side of the slot 92 at its blind end 96. The offset area 98 is deeper than the non-offset area 100 adjacent thereto, as measured along the depth of the slot 92 from the open slot end 102 defined between the distal ends 104 of the fingers 90. The offset area 98 is also wider than a finger 90.

The cutter guide member template 14 is formed with two spaced apart stud receiving apertures 106 which are spaced apart by a distance equal to the distance between the studs 44 projecting from the base top surface 16. The template 14 is placed over the base top surface 16 with the studs 44 projecting through the apertures 106, and the top clamp bar 46 is then located over the top of the template 14. Thus, the top clamp bar 46 also holds the template 14 in position.

Figure 6:
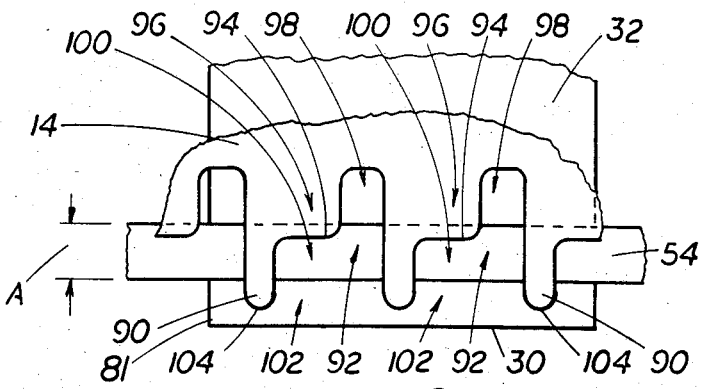
FIG. 6 is an enlarged top plan view of the portion of the fixture shown in FIGS. 4 and 5.

FIGS. 4–6 illustrate the fixture 10 in use for cutting mortises and tenons in first and second workpieces 30 and 32, respectively, for making a flush joint when the two workpieces are assembled. The second workpiece 32 is placed on the base top surface 16 beneath the template 14 with the end in which the mortises and tenons are to be cut in abutment with the abutment edge 56 of the second workpiece positioning bar 54. The wing nuts 52 are tightened down on the studs 44 thereby clamping the second workpiece 32 on the base top surface 16 and the template 14 against the second workpiece 32.

Preferably, the center of the second workpiece 32 is located in alignment with the center of the center one of the fingers 90. Then, the locating bracket 64 is placed so that one of its second workpiece abutment edges, for example the left side abutment edge 78 of the top bracket flange 68, is in abutment with the left side 79 of the second workpiece 32. Next, the first workpiece 30 is placed on the base front surface 18 between the front clamping bar 36 and the base front surface 18. The left side 81 of the first workpiece 30 is located in abutment with the left side abutment edge 74 of the front bracket flange 66 to align the first workpiece 30 with the second workpiece 32, and with the end in which the mortises and tenons are to be cut in contact with the bottom surface of the fingers 90 of the template 14. Then, the wing nuts 42 are tightened down on the studs 34, thereby forcing the front clamping bar 36 toward the base front surface 18 clamping the first workpiece 30 in position.

It should be noted that, as best shown in FIGS. 5 and 6, the adjacent ends of the first and second workpieces 30 and 32, in which the mortises and tenons are to be cut, are spaced apart by the positioning means bar 54. And, as particularly shown in FIG. 6, the distal ends 104 of the fingers 90 of the template 14 are located over the end of the first workpiece 30 to be formed with mortises and tenons, and the offset areas 98 formed by the step 94 at the blind-end 96 of each of the slots 92 are positioned over the end of the second workpiece 32 to be formed with mortises and tenons. The mortises and tenons are cut simultaneously in the first workpiece 30 and second workpiece 32 by placing the base of a router (not shown) on the top surface of the template 14 with the router guide bushing in contact with the edge of the template 14 defining the fingers 90 and tool guide slots 92. Next, the router is moved along the edge 88 of the template 14 so the router guide bushing follows the configuration defined by the fingers 90 and tool guide slots 92 thus cutting matching mortises and tenons in the first and second workpieces 30 and 32.

However, in order to use the fixture 10 to cut mortises and tenons in the first and second workpieces 30 and 32, respectively, for making a rabbeted joint when the two workpieces are assembled, it should be understood that the second workpiece positioning means bar 54 is removed from the fixture 10 and the above procedure is otherwise followed.

It should be further apparent that while there have been described what are currently considered to be presently preferred forms of the present invention in accordance with the Patent Statutes, changes may be made in the disclosed device without departing from the true spirit and scope of this invention. It is, therefore, intended that the appended claims shall cover such modifications and applications that may not depart from the true spirit and scope of the present invention.

What is claimed is:

1. A cutter guide member for a dovetail fixture for guiding a cutting tool in cutting spaced apart, interlocking mortises and tenons, comprising:

(a) a generally flat template having at least one of its edges formed with a plurality of spaced apart cutting tool guide fingers, (b) with the space between adjacent fingers defining a blind ended cutting tool guide slot and each said slot having a step formed at its blind end, wherein the step in the blind end of each said slot defines an offset area of each said slot, and wherein the offset area is located off-center of each said slot toward one side of said slot.

2. The cutter guide member of claim 1, wherein each said slot is wider than a finger.

3. A cutter guide member for a dovetail fixture for guiding a cutting tool in cutting spaced apart, interlocking mortises and tenons, comprising:

(a) a generally flat template having at least one of its edges formed with a plurality of spaced apart cutting tool guide fingers, (b) with the space between adjacent fingers defining a blind ended cutting tool guide slot and each said slot having a step formed at its blind end, wherein the step in the blind end of each said slot defines an offset area deeper than the non-offset area of each said slot, and wherein the offset area of each said slot is wider than a finger.

4. The cutter guide member of claim 3 wherein the fingers are equally spaced along at least one edge of the template.

5. A dovetail fixture for use with a router having a tool bit comprising:

(a) base having a generally horizontal, planar top surface, and a generally vertical, planar front surface substantially perpendicular to said top surface;

(b) means adjacent to said front surface for clamping a first workpiece to the base front surface;

(c) means adjacent to said top surface for clamping a second workpiece to the bases top surface; and (d) a generally flat template above said base having at least one of its edges formed with a plurality of spaced apart cutting guide fingers, with the space between adjacent ones of said fingers defining blind-ended cutting tool guide slot and each said slot having a step formed at its blind end, wherein said step defines an offset area deeper than the non-offset area of each said slot and said offset area is located off center of each said slot toward one side of said slot;

(e) said template being adapted to be located over the second workpiece with the distal ends of said fingers located over the first workpiece and the stepped blind end of each said slot located over the second workpiece.

6. The dovetail fixture of claim 5, further comprising locating means adjacent to said base for locating the first workpiece in alignment with the second workpiece.

7. The dovetail fixture of claim 6, wherein the locating means comprises an abutment surface for contacting a side of the second workpiece and an abutment surface for contacting a side of the first workpiece.

8. The dovetail fixture of claim 1, wherein said locating means comprises a locating bracket having a front flange overlying the base front surface, with one side of said front flange being the abutment surface for contacting a side of the first workpiece, and a top flange for overlying the base top surface, with one side of said top flange being the abutment surface for contacting a side of the second workpiece.

9. The dovetail fixture of claim 8, wherein said locating bracket is adjustably locatable along said base front surface.

10. A dovetail fixture comprising:

(a) a base having a generally horizontal, planar top surface, and a generally vertical, planar front surface substantially perpendicular to said top surface;

(b) means adjacent to said front surface for clamping a first workpiece to the base front surface;

(c) means adjacent to said top surface for clamping a second workpiece to the base top surface;

(d) a generally flat template above said base having at least one of its edges formed with a plurality of spaced apart cutting guide fingers, with the space between adjacent ones of said fingers defining blind-ended cutting tool guide slot and each said slot having a step formed at its blind end;

(e) said template being adapted to be located over the second workpiece with the distal ends of said fingers located over the first workpiece and the stepped blind end of each said slot located over the second workpiece; and (f) positioning means adjacent to said base for positioning an end of the second workpiece to be formed with mortises and tenons at a preselected position spaced rearwardly on the base top surface from the base front surface.

11. The dovetail fixture of claim 10, wherein said positioning means comprises an abutment surface for contacting the end of the second workpiece to be formed with mortises and tenons.

12. The dovetail fixture of claim 10, wherein said positioning means locates the end of the second workpiece to be formed with mortises and tenons in spaced apart adjacent relationship to the end of the first workpiece to be formed with mortises and tenons.

13. The fixture of claim 12, wherein the adjacent ends of the first and second workpieces are spaced apart by a distance equal to at least one-half the diameter of the cutter tool bit.

14. The dovetail fixture of claim 13, wherein said positioning means comprises an elongated bar removably attached to the base top surface, with one longitudinal edge of said elongated bar forming the second workpiece abutment surface.

15. The dovetail fixture of claim 10, wherein the step in the blind end of each said slot defines an offset area deeper than the non-offset area of said slot.

16. The dovetail fixture of claim 15, wherein the offset area is located off-center of said slot toward one side of said slot.

17. The dovetail fixture of claim 16, wherein each said slot is wider than a finger.

18. The dovetail fixture of claim 17, wherein the offset area of each said slot is wider than a finger.

19. The dovetail fixture of claim 18, wherein said plurality of fingers are equally spaced apart along at least one edge of said template.

* * * * *